US010451994B2

(12) United States Patent
Sobue

(10) Patent No.: US 10,451,994 B2
(45) Date of Patent: Oct. 22, 2019

(54) IMAGE FORMING APPARATUS CAPABLE OF CORRECTING POSITION OF IMAGE FORMED ON IMAGE BEARING MEMBER

(71) Applicant: CANON KABUSHIKI KAISHA, Tokyo (JP)

(72) Inventor: Fumitaka Sobue, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/334,601

(22) Filed: Oct. 26, 2016

(65) Prior Publication Data

US 2017/0123340 A1 May 4, 2017

(30) Foreign Application Priority Data

Oct. 28, 2015 (JP) ..... 2015-211849

(51) Int. Cl.
*G03G 15/043* (2006.01)
*G03G 15/01* (2006.01)
*G03G 15/00* (2006.01)

(52) U.S. Cl.
CPC ..... *G03G 15/043* (2013.01); *G03G 15/01* (2013.01); *G03G 15/011* (2013.01); *G03G 15/5058* (2013.01)

(58) Field of Classification Search
CPC ..... G03G 15/50; G03G 15/5041; G03G 15/5054; G03G 2215/0158; G03G 2215/0161
USPC ..... 399/40, 49, 72, 301
See application file for complete search history.

(56) References Cited

U.S. PATENT DOCUMENTS

| | | | | |
|---|---|---|---|---|
| 8,744,325 | B2 | 6/2014 | Ino et al. | |
| 2009/0080915 | A1* | 3/2009 | Hashimoto | G03G 15/0131 399/39 |
| 2011/0280599 | A1* | 11/2011 | Ino | G03G 15/0189 399/44 |
| 2012/0275811 | A1* | 11/2012 | Sasaki | G03G 15/0194 399/72 |

FOREIGN PATENT DOCUMENTS

| | | | |
|---|---|---|---|
| JP | 2004069908 | A | 3/2004 |
| JP | 2012003234 | A | 1/2012 |
| JP | 2014066960 | A | 4/2014 |

* cited by examiner

*Primary Examiner* — Benjamin R Schmitt
(74) *Attorney, Agent, or Firm* — Rossi, Kimms & McDowell LLP

(57) ABSTRACT

An image forming apparatus that is capable of determining whether a measurement image is formed normally. First and second image forming units form first and second images on an image bearing member using first and second color toners. Reflectance of first toner is higher than the image bearing member and is higher than the second toner. A controller controls image forming units to form first and second measurement images superimposed. A correction unit corrects a positional relationship between the first and second images based on a position of the first measurement image detected based on an output timing of a signal indicating that the received light amount is not less than a threshold. A prohibition unit prohibits the correction unit from correcting the positional relationship when a period during which the signal is output is different from a predetermined period.

16 Claims, 11 Drawing Sheets

IMAGE FORMING APPARATUS CAPABLE OF CORRECTING POSITION OF IMAGE FORMED ON IMAGE BEARING MEMBER

BACKGROUND OF THE INVENTION

Field of the Invention

The present invention relates to a position correction control that corrects a position of an image formed on an image bearing member in an image forming apparatus.

Description of the Related Art

An image forming apparatus of an electrophotographic system has image forming units that form images using toners for respective color components. The images formed with these image forming units are transferred onto an image bearing member so as to superimpose. As a result of this, a multicolor image is generated. The image forming apparatus transfers the multicolor image on the image bearing member to a sheet, fixes the multicolor image to the sheet with heat and pressure by a fixing device, and outputs the printed sheet.

Since such an image forming apparatus superimposes images formed with a plurality of image forming units, when at least one image forming unit forms an image at a position different from a target position, color misregistration occurs in a multicolor image on a printed sheet, which lowers quality of the multicolor image.

Accordingly, an image forming apparatus makes an image forming unit form a measurement image with a toner in a predetermined color, measures the measurement image with a sensor, and adjusts an image forming position of the image forming unit on the basis of a measurement result of the sensor. As a result of this, the color misregistration of the multicolor image is reduced.

The sensor that measures the measurement image is provided with a light emitting element and light receiving element, for example. The light emitting element irradiates the image bearing member, and the light receiving element receives reflected light from the image bearing member and reflected light from the measurement image. An output value of the sensor varies according to intensity of the reflected light from the measurement image received with the light receiving element. The image forming apparatus determines positional relationship of the measurement image on the basis of the output value of the sensor, and corrects relative misregistration of the image forming position on the basis of the positional relationship concerned. However, when difference between a reflectance of the image bearing member and a reflectance of the toner of the predetermined color is minute, the positional relationship of the measurement image may not be determined. That is, when the difference between the intensity of the reflected light from the measurement image and the intensity of the reflected light from the image bearing member is minute, the image forming apparatus may not distinguish the reflected light from the measurement image and the reflected light from the image bearing member.

The technique disclosed in Japanese Laid-Open Patent Publication (Kokai) No. 2012-3234 (JP 2012-3234A) measures a position of a measurement image formed with a toner of a predetermined color using a superimposed measurement image. The superimposed measurement image is formed by superimposing a measurement image that is formed using the toner of the predetermined color on a measurement image formed using a toner of another color different from the predetermined color. It should be noted that the reflectance of the toner of the other color differs from the reflectance of the image bearing member. In the superimposed measurement image of the above-mentioned publication, the measurement image of the predetermined color has a slit and the measurement image of the other color appears in the slit. The above-mentioned sensor outputs the output value corresponding to the intensity of the reflected light from the measurement image of the other color appeared in the slit. Since the output value of the sensor also varies when the positional relationship between the measurement image of the predetermined color and the measurement image of the other color varies, the image forming apparatus is able to measure the position of the measurement image in the predetermined color.

However, when the misregistration of the measurement image of the predetermined color goes beyond a tolerance, the measurement image of the predetermined color may be superimposed on another measurement image different from the superimposed measurement image. Accordingly, when the misregistration of the measurement image of the predetermined color goes beyond the tolerance, the image forming position of the measurement image of the predetermined color is misdetected. Accordingly, when the misregistration of the measurement image of the predetermined color goes beyond the tolerance, the image forming apparatus cannot correct the color misregistration appropriately.

SUMMARY OF THE INVENTION

The present invention provides an image forming apparatus that is capable of determining whether a measurement image is formed normally.

Accordingly, a first aspect of the present invention provides an image forming apparatus including an image bearing member, a first image forming unit configured to form a first image on the image bearing member using a first color toner of which reflectance is higher than the image bearing member, a second image forming unit configured to form a second image on the image bearing member using a second color toner of which reflectance is lower than the first color, a controller configured to control the first image forming unit to form a first measurement image on the image bearing member, and to control the second image forming unit to form a second measurement image such that the second measurement image is superimposed on the first measurement image formed on the image bearing member, an irradiation unit configured to irradiate the image bearing member with light, an output unit configured to have a light receiving section that receives reflected light from the first measurement image and the second measurement image, and to output a signal based on a result of the reflected light received by the light receiving section, the signal including a first signal and a second signal, a detection unit configured to detect color misregistration based on a timing at which the output unit outputs the first signal, a correction unit configured to correct a positional relationship between the first image and the second image based on a detection result of the detection unit, and a prohibition unit configured to prohibit the correction unit from correcting the positional relationship based on the detection result in a case where a period during which the output unit outputs the first signal is different from a predetermined period.

According to the present invention, it is capable of determining whether the measurement image is formed normally, which enables to correct color misregistration appropriately.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
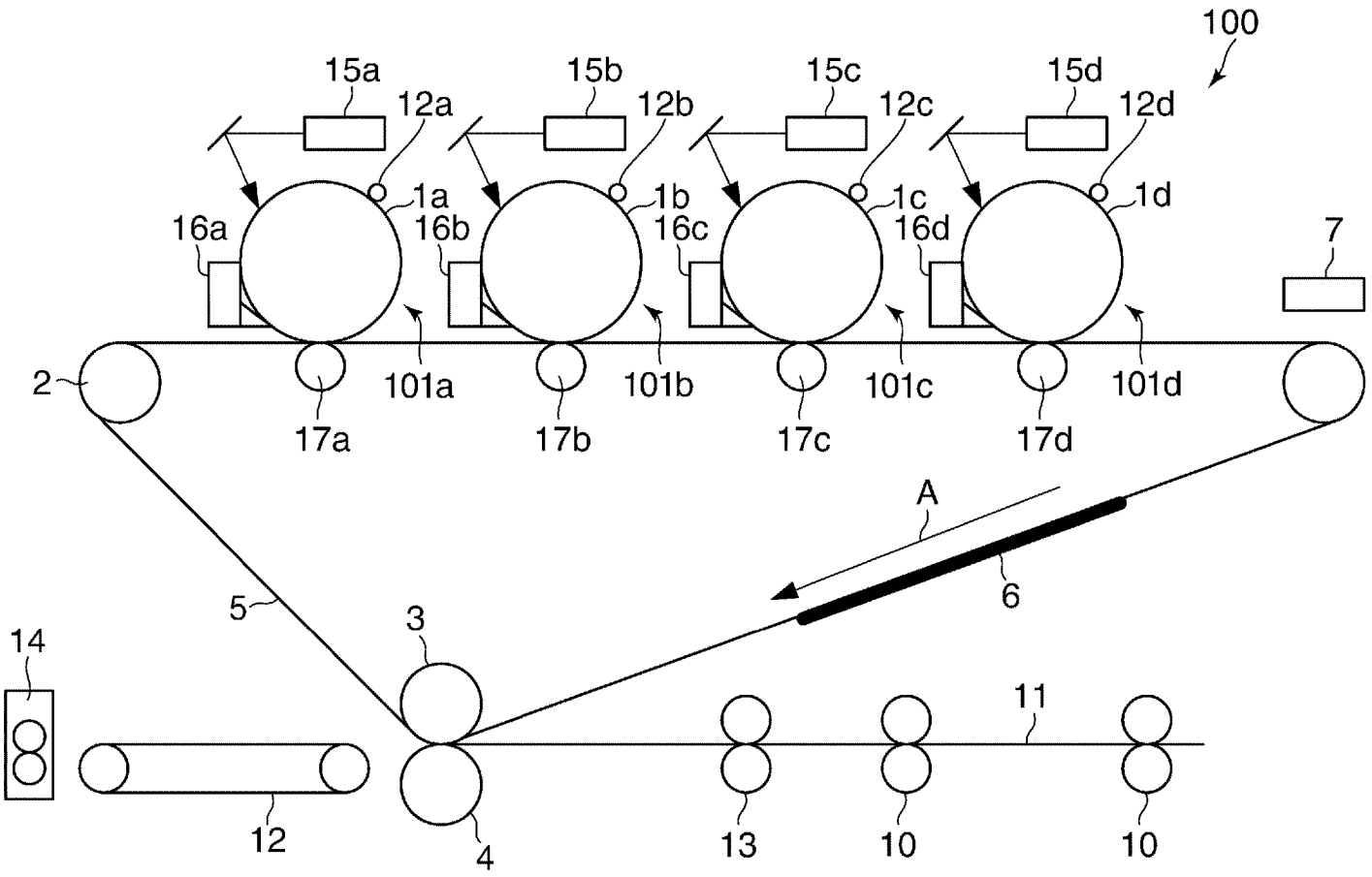
FIG. 1 is a sectional view schematically showing a configuration of an image forming apparatus according to a first embodiment of the present invention.

FIG. 1 is a sectional view schematically showing a configuration of an image forming apparatus 100 according to a first embodiment of the present invention. The image forming apparatus 100 forms a color image by superimposing a plurality of images.

The image forming apparatus 100 is provided with image forming units 101*a*, 101*b*, 101*c*, and 101*d*. The image forming units 101*a*, 101*b*, 101*c*, and 101*d* respectively form a yellow (Y) image, magenta (M) image, cyan (C) image, and black (K) image. The image forming units 101*a*, 101*b*, 101*c*, and 101*d* are respectively provided with photosensitive drums 1*a*, 1*b*, 1*c*, and 1*d*. A photosensitive layer is formed on a surface of each of the photosensitive drums 1*a*, 1*b* 1*c*, and 1*d*. The photosensitive layer of each of the photosensitive drums 1*a*, 1*b*, 1*c*, and 1*d* functions as a photoreceptor. The photosensitive drums 1*a*, 1*b*, 1*c*, and 1*d* are respectively rotated by motors (not shown). Electrostatic chargers (electrification unit) 12*a*, 12*b*, 12*c*, and 12*d*, exposure devices (exposure unit) 15*a*, 15*b*, 15*c*, and 15*d*, and development devices (developing unit) 16*a*, 16*b*, 16*c*, and 16*d* are arranged around the photosensitive drums 1*a*, 1*b*, 1*c*, and 1*d*. Moreover, transfer rollers 17*a*, 17*b*, 17*c*, and 17*d* are respectively arranged around the photosensitive drums 1*a*, 1*b*, 1*c*, and 1*d*.

A high voltage power supply (not shown) applies voltage to the electrostatic chargers 12*a*, 12*b*, 12*c*, and 12*d*. The electrostatic chargers uniformly charge the photosensitive drums 1*a*, 1*b*, 1*c*, and 1*d* on the basis of the voltage supplied from the high voltage power supply.

Each of the exposure devices 15*a*, 15*b*, 15*c*, and 15*d* is provided with a light source that projects a laser beam, a controlling driver that controls the laser beam, a polygon mirror that deflects the laser beam, and a polygon motor that drivingly rotates the polygon mirror. Moreover, the exposure devices 15*a*, 15*b*, 15*c*, and 15*d* are provided with various mirrors for guiding the laser beams to the photosensitive drums 1*a*, 1*b*, 1*c*, and 1*d*, respectively. The controlling drivers respectively control the laser beams projected from the light sources on the basis of image data. When the polygon motors rotate, the laser beams respectively scan the photosensitive drum. Accordingly, electrostatic latent images are formed on the photosensitive drums 1*a*, 1*b*, 1*c*, and 1*d* on the basis of the image data.

The development devices 16*a*, 16*b*, 16*c*, and 16*d* respectively develop the electrostatic latent images on the photosensitive drums 1*a*, 1*b*, and 1*c* and 1*d* using toners. Accordingly, toner images are born on the photosensitive drums 1*a*, 1*b*, 1*c*, and 1*d*. The yellow toner image is born on the photosensitive drum 1*a*. The magenta toner image is born on the photosensitive drum 1*b*. The cyan toner image is born on the photosensitive drum 1*c*. The black toner image is born on the photosensitive drum 1*d*.

The transfer rollers 17*a*, 17*b*, 17*c*, and 17*d* transfer the toner images on the photosensitive drums 1*a*, 1*b*, 1*c*, and 1*d* to an intermediate transfer belt 5. The toner images of the four colors on the photosensitive drums 1*a*, 1*b*, 1*c*, and 1*d* are sequentially transferred so as to be superimposed, and a full color toner image 6 is formed on the intermediate transfer belt 5 that is an intermediate transfer medium. The intermediate transfer belt 5 is looped over a plurality of rollers including a driving roller 2 and roller 3. The driving roller 2 is rotated by a motor (not shown). When the driving roller 2 rotates, the intermediate transfer belt 5 rotates in a direction of an arrow A. The toner image 6 born on the intermediate transfer belt 5 is conveyed to a transfer nip position between the roller 3 and a transfer roller 4. An area where the roller 3 and the transfer roller 4 nip the intermediate transfer belt 5 is the transfer nip position. Moreover, a pair of pattern detection sensors 7*a* and 7*b* are arranged so as to face the belt surface of the intermediate transfer belt 5. The pattern detection sensors 7*a* and 7*b* detect a color registration pattern formed on the intermediate transfer belt 5. Details of the color registration pattern will be mentioned later.

The image forming apparatus 100 has two sets of conveying roller pairs 10 and a registration roller pair 13. The conveying roller pairs 10 and the registration roller pair 13 function as a conveyance mechanism that conveys a sheet along a conveyance path 11. The registration roller pair 13 controls a sheet conveyance timing so that a timing at which the toner image 6 on the intermediate transfer belt 5 reaches the transfer nip position matches a timing at which the sheet reaches the transfer nip position. The toner image 6 on the intermediate transfer belt 5 is transferred to the sheet by applying transfer voltage to the transfer roller 4 while the toner image 6 on the intermediate transfer belt 5 and the sheet are passing through the transfer nip position. A conveying belt 12 brings out the sheet to which the toner image 6 was transferred to a fixing device 14.

The fixing device 14 has a fixing unit having a heater and a pressure unit. The pressure unit presses the toner image 6 to the sheet, while the heater heats the toner image 6. As a result of this, the toner image 6 on the sheet is fixed to the sheet. The sheet to which the toner image 6 was fixed by the fixing device 14 is ejected from the image forming apparatus 100 by an ejecting roller (not shown).

Figure 2:
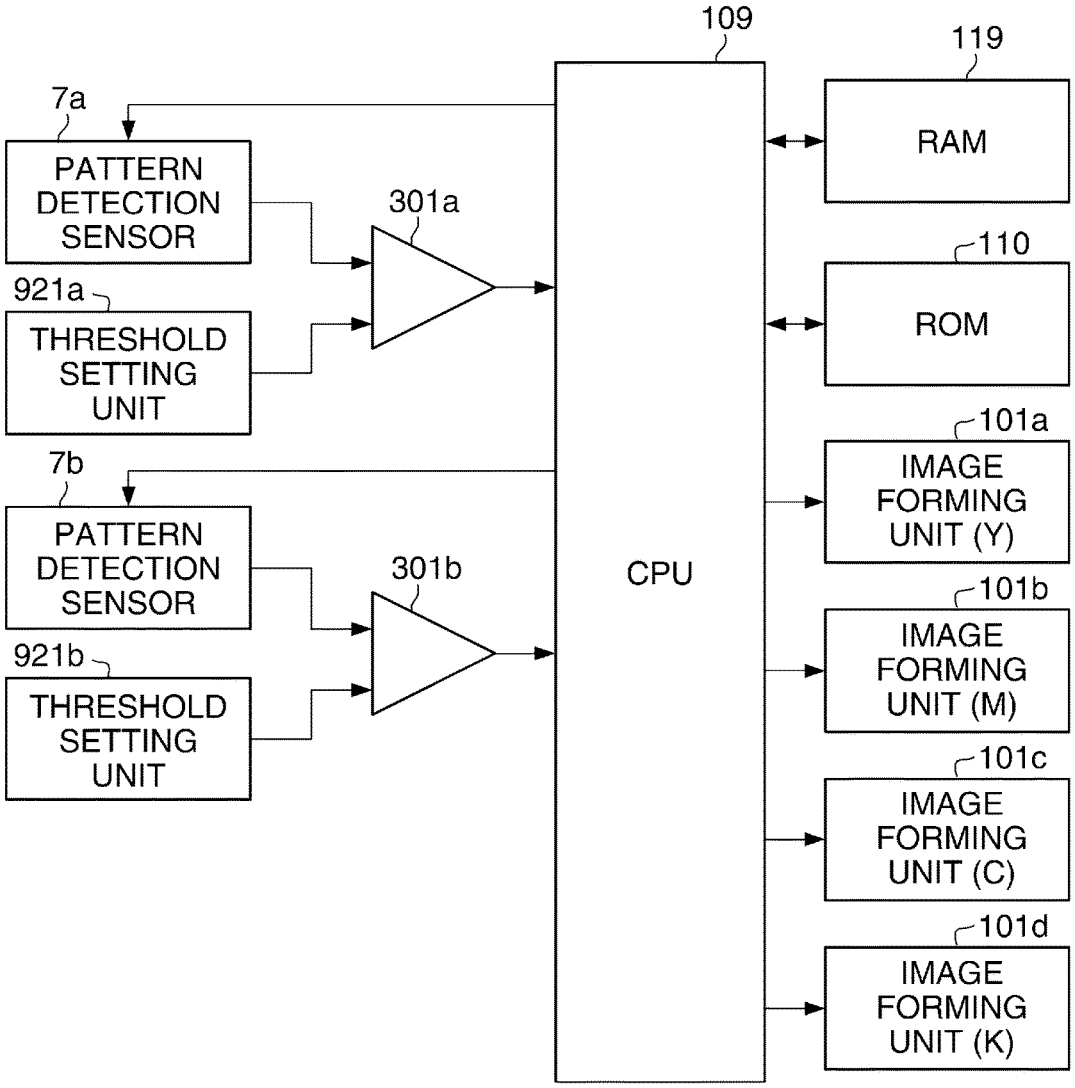
FIG. 2 is a block diagram schematically showing a control system of the image forming apparatus shown in FIG. 1.

FIG. 2 is a block diagram schematically showing a control system of the image forming apparatus 100 shown in FIG. 2.

The control system shown in FIG. 2 is provided with a CPU 109 that controls each part of the image forming apparatus 100. The CPU 109 is connected with the image forming units 101*a*, 101*b*, 101*c*, and 101*d*, a ROM 110, a RAM 119, comparators 301*a* and 301*b*, and the pattern detection sensors 7*a* and 7*b*. Moreover, the comparator 301*a* compares outputs of the pattern detection sensor 7*a* and a threshold setting unit 921*a*, and the comparator 301*b* compares outputs of the pattern detection sensor 7*b* and a threshold setting unit 921*b*.

The CPU 109 controls each component member on the basis of a program stored in the ROM 110. The CPU 109 makes the image forming units 101*a*, 101*b*, 101*c*, and 101*d* form an image on the basis of image data. Moreover, when correcting color misregistration, the CPU 109 makes the image forming units 101*a*, 101*b*, 101*c*, and 101*d* form color registration patterns on the basis of measurement image data. The ROM 110 stores various programs and the measurement image data. The RAM 119 functions as a work area for the CPU 109.

The image forming units 101*a*, 101*b*, 101*c*, and 101*d* form images in response to instructions of the CPU 109. That is, the exposure devices 15*a*, 15*b*, 15*c*, and 15*d* of the image forming units 101*a*, 101*b*, 101*c*, and 101*d* make the laser diodes output the light beams according to image data so that the electrostatic latent images of the corresponding colors are respectively formed on the photosensitive drums 1*a*, 1*b*, 1*c*, and 1*d*. The development devices 16*a*, 16*b*, 16*c*, and 16*d* develop the electrostatic latent images to form the toner images of the four colors. The toner images are sequentially transferred to the intermediate transfer belt 5 and are superimposed to form a color image.

Figure 4:
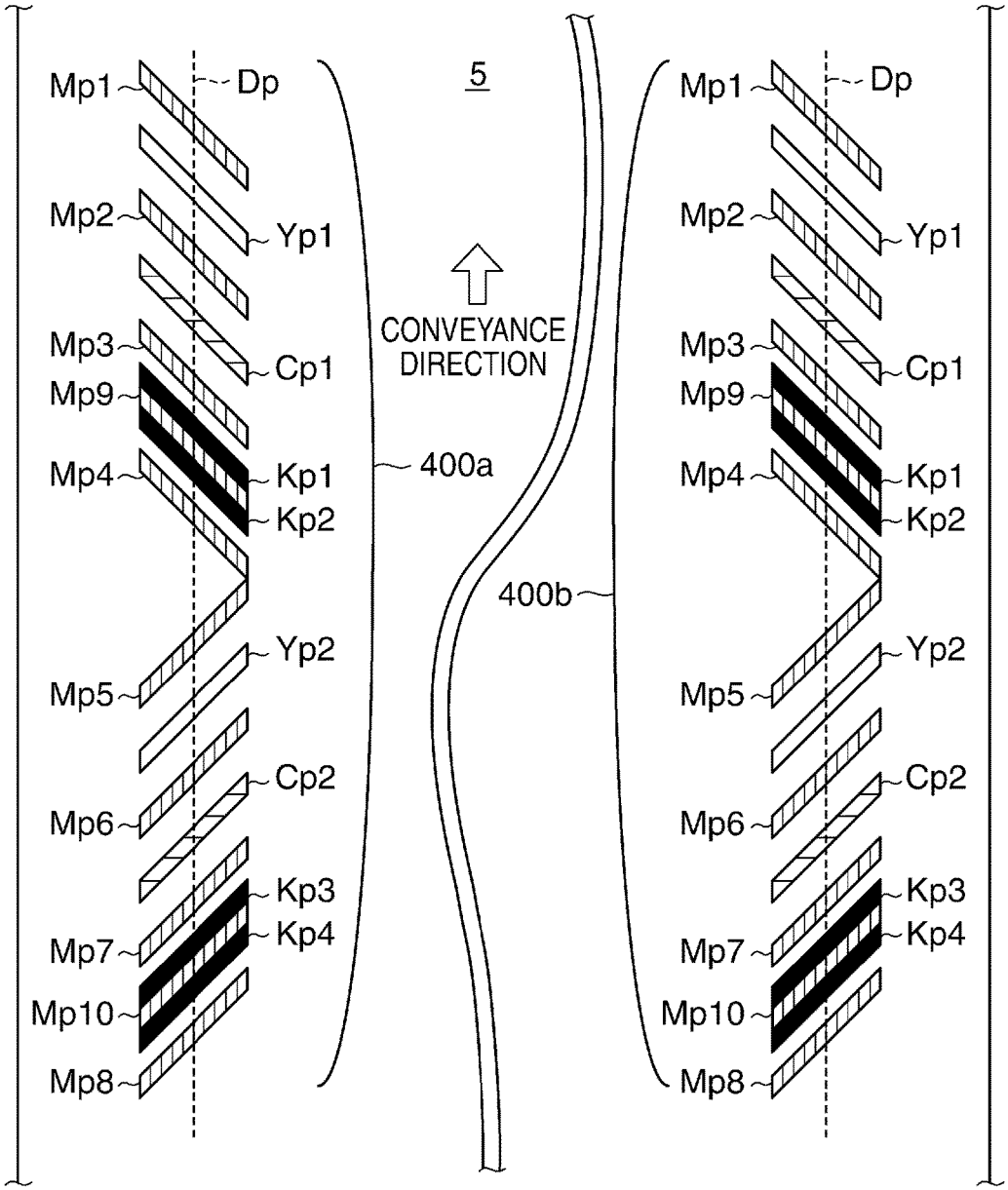
FIG. 4 is a view showing a color registration pattern.

The pattern detection sensors 7*a* and 7*b* are irregular-reflection optical sensors that receive irregular reflection light from the color registration pattern formed on the intermediate transfer belt 5. As shown in FIG. 4, the pattern detection sensor 7*a* is arranged so as to face a color registration pattern 400*a* that is formed near one end in a direction that intersects perpendicularly with the conveyance direction of the intermediate transfer belt 5, for example. Moreover, as shown in FIG. 4, the pattern detection sensor 7*b* is arranged so as to face a color registration pattern 400*b* that is formed near the other end in the direction that intersects perpendicularly with the conveyance direction of the intermediate transfer belt 5, for example.

The pattern detection sensor 7*a* detects the color registration pattern 400*a*, and outputs an analog signal Asa to the comparator 301*a*. Similarly, the pattern detection sensor 7*b* detects the color registration pattern 400*b*, and outputs an analog signal Asb to the comparator 301*b*.

The comparator 301*a* is an analog/digital converter that compares the level of the analog signal Asa with a threshold Tha and outputs a digital signal Dsa as an output signal. Similarly, the comparator 301*b* is an analog/digital converter that compares the level of the analog signal Asb with a threshold Thb and outputs a digital signal Dsb as an output signal. That is, the comparator 301*a* compares the level of the analog signal Asa from the pattern detection sensor 7*a* with the threshold Tha set up by the threshold setting unit 921*a*, and outputs the digital signal Dsa, which is a comparison result of whether the level is equal to or more than the threshold, to the CPU 109. Similarly, the comparator 301*b* compares the level of the analog signal Asb from the pattern detection sensor 7*b* with the threshold Thb set up by the threshold setting unit 921*b*, and outputs the digital signal Dsb, which is a comparison result of whether the level is equal to or more than the threshold, the CPU 109.

A the CPU 109 calculates a color misregistration amount by processing these digital signals Dsa and Dsb, and adjusts the writing start timing of each exposure device corresponding to the color misregistration amount. Furthermore, the CPU 109 functions as an adjusting unit that adjusts an image forming position of each color on the basis of the calculated color misregistration amount.

The image forming apparatus 100 executes a color registration adjustment. The pattern detection sensors 7*a* and 7*b* detect the color registration patterns 400*a* and 400*b* formed on the intermediate transfer belt 5. The CPU 109 obtains relative misregistrations between the image forming positions of the toner images of the four colors (color misregistration amounts) on the basis of the detection results of the patterns 400*a* and 400*b* by the pattern detection sensors 7*a* and 7*b*. Then, the CPU 109 determines correction amounts on the basis of the color misregistration amounts, and adjusts the image forming positions on the basis of the correction amounts concerned. As a result of this, since the images of the four colors are formed so as to be superimposed, the color misregistration is corrected. The image forming positions are corrected by adjusting the image writing start timings of the exposure devices 15*a*, 15*b*, 15*c*, and 15*d*, for example.

Hereinafter, the color registration adjustment will be described.

Figure 3:
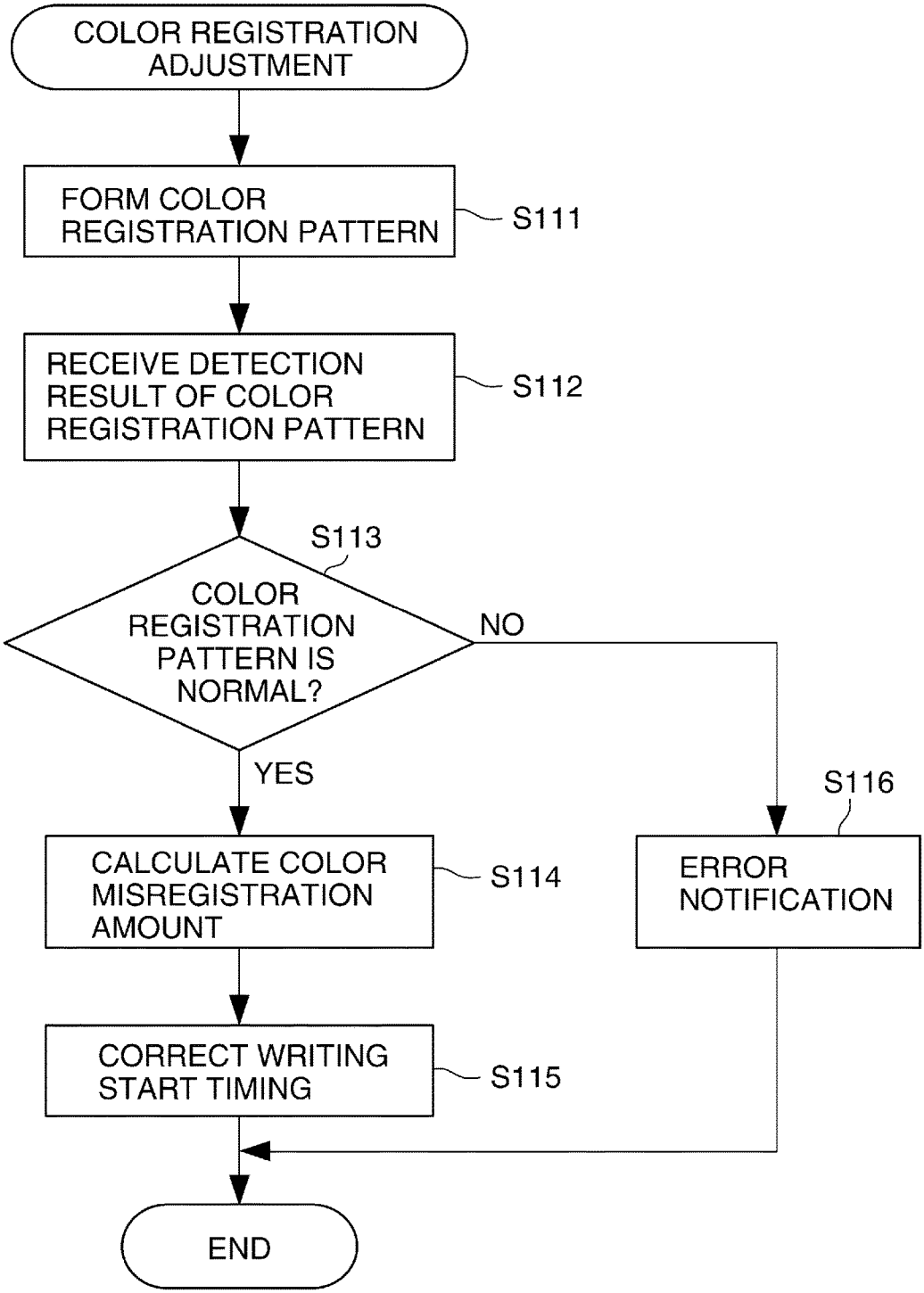
FIG. 3 is a flowchart showing procedures of a color registration adjustment using the image forming apparatus shown in FIG. 1.

FIG. 3 is a flowchart showing procedures of the color registration adjustment using the image forming apparatus 100 shown in FIG. 1. The CPU 109 of the image forming apparatus 100 performs the color registration adjustment according to a color registration adjustment program stored in the ROM 110. The color registration adjustment includes a pattern-abnormality detection step for detecting an abnormal condition showing that the image forming position of the pattern image of the second color exceeds tolerance.

As shown in FIG. 3, when the color registration adjustment starts, the CPU 109 first makes the image forming units 101*a*, 101*b*, 101*c*, and 101*d* form the color registration patterns 400*a* and 400*b* on the intermediate transfer belt 5 on the basis of measurement image data (step S111). In the step S111, the color registration patterns 400*a* and 400*b* are formed on the intermediate transfer belt 5.

FIG. 4 is a view showing the color registration patterns 400*a* and 400*b*.

The color registration patterns 400*a* and 400*b* are formed at the positions that pass measuring positions of the pattern detection sensors 7*a* and 7*b*. The color registration patterns 400*a* and 400*b* on the intermediate transfer belt 5 are formed with a predetermined distance away from each other in a width direction that intersects perpendicularly with the conveyance direction of the intermediate transfer belt 5, for example. The pattern detection sensor 7*a* measures the color registration pattern 400*a*, and the pattern detection sensor 7*b* measures the color registration pattern 400*b*.

Each of the color registration patterns 400*a* and 400*b* includes a pattern of a reference color with high reflectance, a pattern of a color with high reflectance other than the reference color, and a composite pattern that combines a pattern of the reference color with high reflectance and a pattern of a color with low reflectance. Furthermore, patterns of one group included in each of the color registration patterns 400*a* and 400*b* incline by a first angle in a predetermined direction with respect to the conveyance direction of the intermediate transfer belt 5. Patterns of another group incline by a second angle different from the first angle with respect to the conveyance direction of the intermediate transfer belt 5. Then, the patterns of the one group and the patterns of the other group are formed so as to be symmetrical with respect to the line that intersects perpendicularly with the conveyance direction of the intermediate transfer belt 5.

Each of the color registration patterns 400*a* and 400*b* has magenta patterns Mp1, Mp2, Mp3, Mp4, Mp5, Mp6, Mp7, Mp8, Mp9, and Mp10, cyan patterns Cp1 and Cp2, yellow patterns Yp1 and Yp2, and black patterns Kp1, Kp2, Kp3, and Kp4.

The magenta patterns are the reference color patterns with the high reflectance for measuring the color misregistration amount. The width of each of the patterns Mp9 and Mp10 is broader than the width of the each of the patterns Mp1 through Mp8. The yellow patterns Yp1 and Yp2, and the cyan patterns Cp1 and Cp2 are not the reference color patterns, but they are patterns with the high reflectance. The black patterns are patterns with the low reflectance as compared with the yellow, magenta, and cyan patterns.

The composite patterns are used for detecting the color misregistration of the black patterns with the low reflectance. The composite patterns are formed by superimposing an upper layer that consists of the black patterns Kp1 and Kp2 (Kp3 and Kp4) on a base layer that consists of the magenta pattern Mp9 (Mp10) that is the reference color pattern with the high reflectance. When a reflected light from the magenta pattern Mp9 (Mp10) that appears in a slit between the black patterns Kp1 and Kp2 (Kp3 and Kp4) is received, the position of the slit (i.e., the positions of the black patterns) is detected. As a result of this, the color misregistration amount of the black pattern to the reference color pattern is detected. As shown in FIG. 4, dotted lines Dp indicate the measuring positions where the pattern detection sensors 7*a* and 7*b* measure the color registration patterns 400*a* and 400*b*. It should be noted that the slits are prolonged in the directions that intersect the conveyance direction of the intermediate transfer belt 5. Moreover, the reference color patterns with the high reflectance are formed in front of and behind each of the composite patterns in the conveyance direction of the intermediate transfer belt 5 so as to be adjacent to each of the composite patterns.

Referring back to FIG. 3, after the color registration patterns were formed on the intermediate transfer belt 5 (step S111), the CPU 109 makes the pattern detection sensors 7*a* and 7*b* detect the color registration patterns 400*a* and 400*b*, and the CPU 109 receives detection results (step S112).

Figure 5:
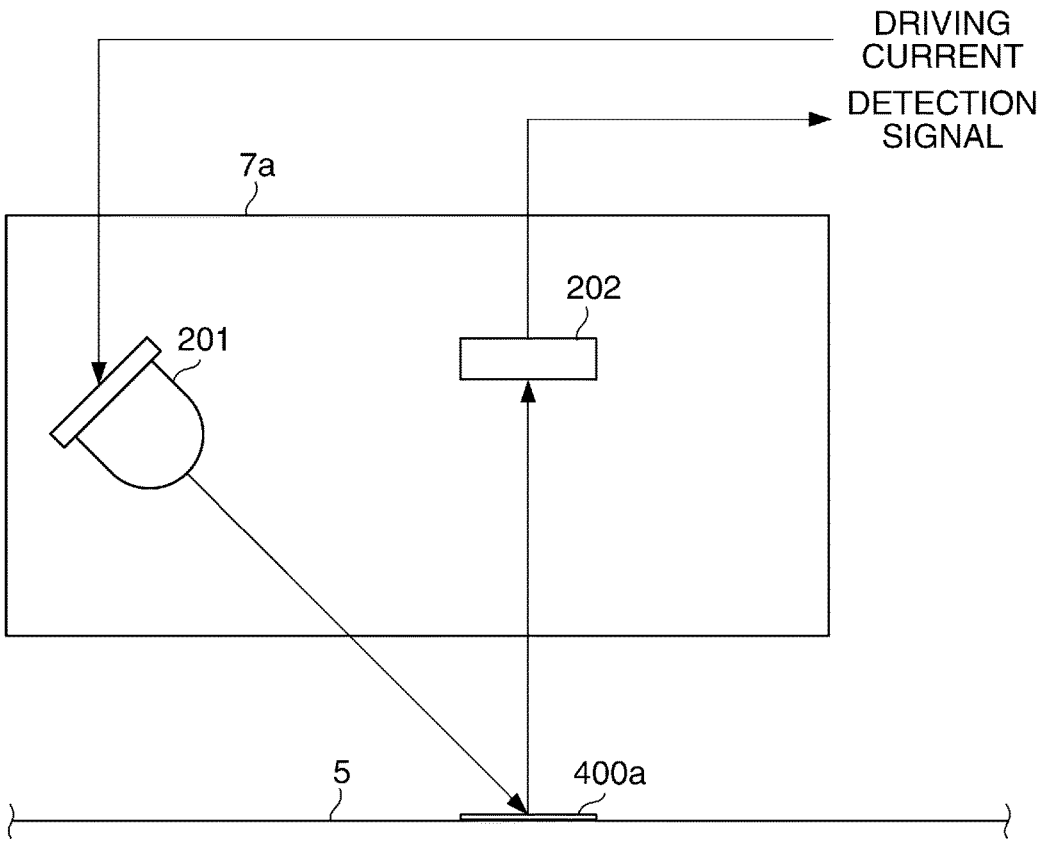
FIG. 5 is a view schematically showing a configuration of a pattern detection sensor.

FIG. 5 is a view schematically showing a configuration of the pattern detection sensor 7*a*. Although FIG. 5 shows the pattern detection sensor 7*a* that detects the color registration pattern 400*a*, the pattern detection sensor 7*b* that detects the color registration pattern 400*b* has the same configuration.

As shown in FIG. 5, the pattern detection sensor 7*a* is provided with a light emitting section 201 and a light receiving section 202. The light emitting section 201 is a light emitting element that irradiates the intermediate transfer belt 5 with light according to a driving current. The light emitted from the light emitting section 201 irradiates the intermediate transfer belt 5 or the color registration pattern 400*a* formed thereon. The area on the intermediate transfer belt 5 irradiated with the light of the light emitting section 201 includes the measuring point. While a pattern included in the color registration pattern 400*a* is passing the measuring position, the light receiving section 202 receives irregular reflection light from the pattern. On the other hand, while the color registration pattern 400*a* is not passing the measuring position, the light receiving section 202 receives irregular reflection light from the surface of the intermediate transfer belt 5. The light receiving section 202 has a light receiving element that outputs the photocurrent corresponding to the light amount of the received light. The light receiving section 202 converts the photocurrent of the light receiving element into an analog detection signal (voltage value) As, and outputs it.

Referring back to FIG. 3, after receiving the detection results about the color registration patterns from the pattern detection sensors 7*a* and 7*b*, the CPU 109 determines whether the color registration patterns are normal (step S113).

Figure 6A:
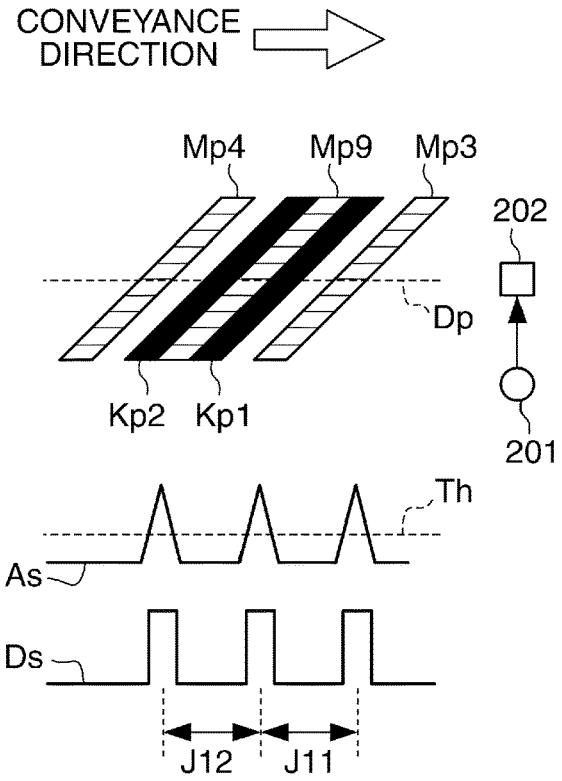
FIG. 6A is a view showing a composite pattern as a color registration pattern and a waveform of a detection signal in a normal state.
Figure 6B:
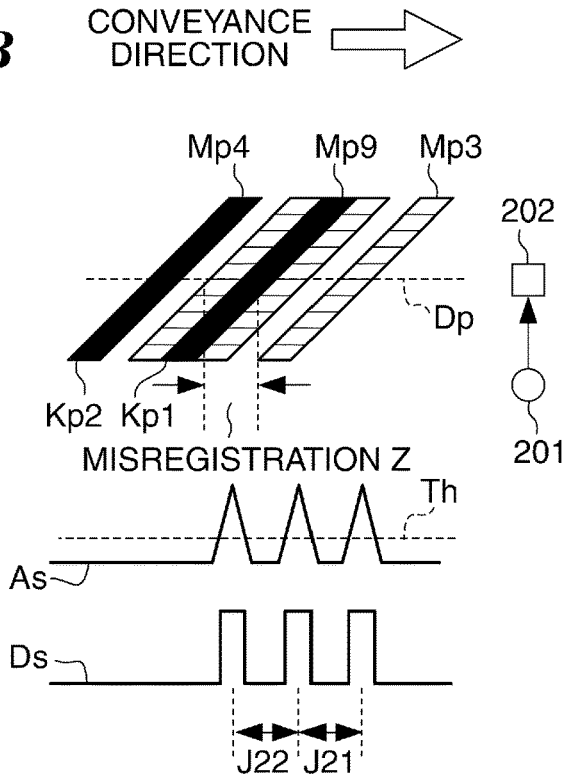
FIG. 6B is a view showing a composite pattern as a color registration pattern and a waveform of a detection signal in an abnormal state.

FIG. 6A is a view showing the composite pattern in the color registration pattern and a waveform of a detection signal of the pattern detection sensor 7*a* in a normal state. FIG. 6B is a view showing a composite pattern in the color registration pattern and a waveform of a detection signal of the pattern detection sensor 7*a* in an abnormal state.

Each of FIG. 6A and FIG. 6B shows the composite pattern, the detection signal output from the pattern detection sensor 7*a* at the time when the pattern detection sensor 7*a* detects the composite pattern, and the detection signal (binary) output from the comparator 301*a*.

The width of the magenta pattern Mp9 is wider than the width of the magenta pattern Mp3 in the conveyance direction. Similarly, the width of the magenta pattern Mp9 is wider than the width of the magenta pattern Mp4 in the conveyance direction. FIG. 6A shows the normal state in which the magenta pattern with the high reflectance and the black pattern with the low reflectance are located in normal positions. On the other hand, FIG. 6B shows the abnormal state in which the position of the black pattern cannot be recognized normally because the magenta pattern with the high reflectance and the black pattern with the low reflectance were relatively shifted.

When the composite pattern is in the normal state as shown in FIG. 6A, a middle point between a centroid position of a detection signal (pulse) at the time of detecting the pattern Mp4 and a centroid point of a detection signal (pulse) at the time of detecting the pattern Mp3 agrees with a centroid point of a detection signal (pulse) at the time of detecting the pattern Mp9. It should be noted that the magenta pattern Mp9 appears in the slit between the black patterns Kp2 and Kp1. A period J11 is equivalent to a period between the centroid point of the detection signal (pulse) at the time of detecting the pattern Mp3 and the centroid point of the detection signal (pulse) at the time of detecting the pattern Mp9 that appears between the patterns Kp2 and Kp1. Furthermore, a period J12 is equivalent to a period between the centroid point of the detection signal (pulse) at the time of detecting the pattern Mp9 that appears between the patterns Kp2 and Kp1 and the centroid point of the detection signal (pulse) at the time of detecting the pattern Mp4.

On the other hand, when the composite pattern is in the abnormal state as shown in FIG. 6B, since the magenta pattern Mp4 is covered with the black pattern Kp2, the detection signal of the magenta pattern Mp4 does not appear. However, the black pattern Kp1 covers a part of the magenta pattern Mp9. Accordingly, since the both ends (front end and rear end) of the magenta pattern Mp9 in the conveyance direction are exposed, the detection signals corresponding to the both ends of the magenta pattern Mp9 exceed the threshold. Accordingly, three pulses, which include two pulses corresponding to the two detection signals of the magenta pattern Mp9 and one pulse corresponding to the detection signal of the magenta pattern Mp3, are output. In this case, the misregistration amount of the black pattern to the magenta pattern is equivalent to "z" in FIG. 6B.

However, the CPU 109 determines that the pulses of the both sides in FIG. 6B were obtained from the reference color patterns Mp4 and Mp3, and determines that the center pulse was output due to the reflected light from the pattern Mp9 that appears between the patterns Kp2 and Kp1. In this case, the CPU 109 corrects the writing start timing of a black image so that the period J21 becomes equal to the period J22, for example. As a result, the correction for misregistration that is different from the actual misregistration amount "z" will be performed, and an abnormal color image in which the position of the black image is shifted from the positions of the other color images will be output.

In order to avoid the output of such an abnormal image, it is necessary to determine the misregistration amount of the color registration pattern correctly.

Determination of whether the color registration pattern is normal is performed as follows.

Figure 7A:
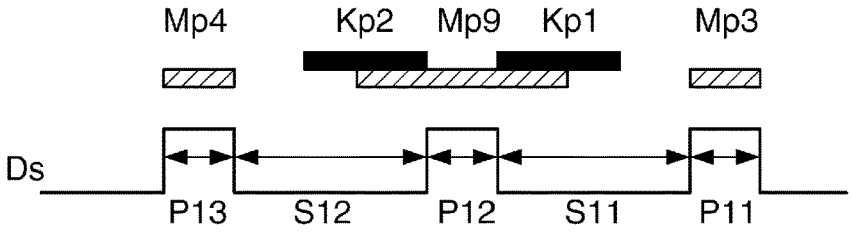
FIG. 7A is a view showing a section of the composite pattern in the normal state and a corresponding detection signal.

FIG. 7A is a schematic view showing a section of the composite pattern in the normal state and a corresponding detection signal. FIG. 7B through FIG. 7E are views showing sections of the composite patterns in the abnormal state and corresponding detection signals, respectively.

In each of FIG. 7A through FIG. 7E, an upper part is a schematic sectional view of the composite pattern, and a lower part shows a detection signal (pulse) of the composite pattern that is detected by the pattern detection sensor. When the pulse width corresponding to the pattern Mp4, the pulse width corresponding to the pattern Mp3, the pulse width corresponding to the pattern Mp3, and the pulse width corresponding to the pattern Mp9 that appears between the patterns Kp2 and Kp1 are outside a predetermined pulse width range, it is determined as the abnormal state. Moreover, when a period between the first pulse corresponding to the pattern Mp3 and the third pulse corresponding to the pattern Mp4 is outside a predetermined period range, the composite pattern is determined as the abnormal state.

The predetermined pulse width range is determined on the basis of a pulse width of an ideal digital signal that is determined according to a physical width of a specific pattern in the composite pattern at the position where the pattern passes the sensor, the conveyance speed of the color registration pattern, and the threshold used when an analog signal is digitized. Moreover, the predetermined period range is determined on the basis of a physical distance between the reference color patterns Mp3 and Mp4, and the conveyance speed of the color registration pattern.

Hereinafter, a concrete abnormality detecting method for the composite pattern performed in the step S113 (FIG. 3) will be described.

In FIG. 7A through FIG. 7E, each of symbols P11 through P53 indicates a pulse width (period) corresponding to a specific pattern. Moreover, each of symbols S11 through S52 indicates a period corresponding to an interval between adjacent pulses. For example, the symbol S11 indicates a period between fall of a first pulse (width P11) and rise of a second pulse (width P12). The symbol S12 indicates a period between fall of the second pulse (width P12) and rise of a third pulse (width P13).

In FIG. 7A, the symbol P11 indicates the width (period) of the pulse that is output after comparing the analog signal obtained from the magenta pattern Mp3 with the threshold. The symbol P12 indicates the width (period) of the pulse obtained from the magenta pattern Mp9 that appears between the black patterns Kp1 and Kp2. Moreover, the symbol P13 indicates the width (period) of the pulse obtained from magenta pattern Mp4. When the composite pattern is in the normal state, the pulse widths P11, P12, and P13 become equal to ideal pulse widths shown in FIG. 7A, and the period (P11+S11+P12+S12) between the output timing of the first pulse (width P11) and the output timing of the third pulse (width P13) becomes equal to a normal value shown in FIG. 7A.

Figure 7B:
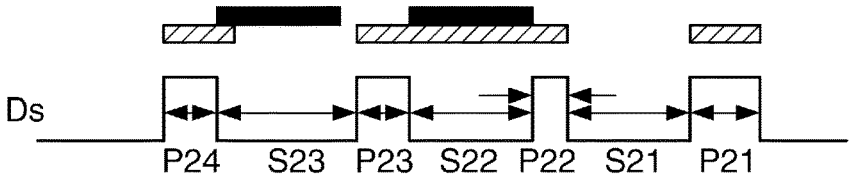
FIG. 7B through FIG. 7E are views showing sections of the composite patterns in the abnormal state and corresponding detection signals, respectively.

Next, in the example of FIG. 7B, the black pattern Kp2 runs onto the magenta pattern Mp4, the black pattern Kp1 runs onto the magenta pattern Mp9, and four pulses appear. In this case, when the widths (periods) of the right three pulses are measured, the pulse widths P22 and P23 are respectively shorter than the normal pulse widths P12 and P13. The period (P21+S21+P22+S22) between the output timing of the first pulse (width P21) and the output timing of the third pulse (width P23) is shorter than the predetermined period (P11+S11+P12+S12). Accordingly, the composite pattern in FIG. 7B is determined to be in the abnormal state.

Figure 7C:
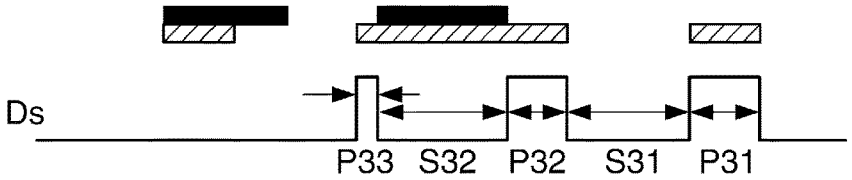

Next, in the example of FIG. 7C, the black pattern Kp2 runs onto the magenta pattern Mp4, the black pattern Kp1 runs onto the magenta pattern Mp9, and three pulses appear. In this case, when the widths (periods) of the right three pulses are measured, the pulse widths P32 and P33 are respectively shorter than the normal pulse widths P12 and P13. The period (P31+S31+P32+S32) between the output timing of the first pulse (width P31) and the output timing of the third pulse (width P33) is shorter than the predetermined period (P11+S11+P12+S12). Accordingly, the composite pattern in FIG. 7C is determined to be in the abnormal state.

Figure 7D:
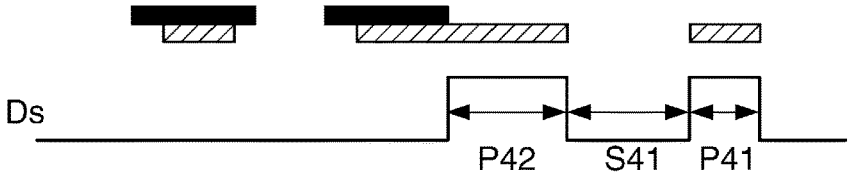

Next, in the example of FIG. 7D, the black pattern Kp2 runs onto the magenta pattern Mp4, the black pattern Kp1 runs onto the magenta pattern Mp9, and two pulses appear. Accordingly, since the number of pulses is fewer than the predetermined number, it is determined as an abnormal pattern. It should be noted that the pulse width P42 is longer than the normal pulse width P12 in this case.

Figure 7E:
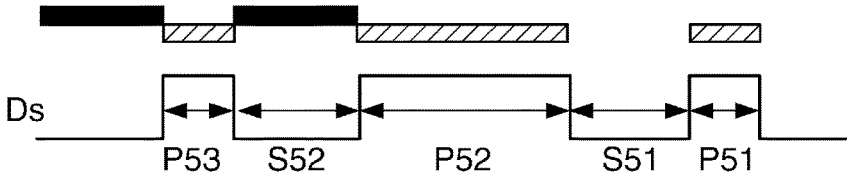

Next, in the example of FIG. 7E, the black pattern Kp2 is located behind the magenta pattern Mp4 in the conveyance direction, and the black pattern Kp1 is located between the magenta pattern Mp4 and the magenta pattern Mp9. Although the period (P51+S51+P52+S52) between the output timing of the first pulse (width P51) and the output timing of the third pulse (width P53) is normal, the pulse width P52 of the second pulse is longer than the normal pulse width P12. Accordingly, it is determined as an abnormal pattern.

When the abnormality of the color registration pattern is detected, the fact that the color registration pattern is abnormal is reported. Furthermore, a color registration pattern may be formed again, for example.

Referring back to FIG. 3, when the color registration pattern is normal ("YES" in the step S113) as a result of determination of whether the color registration pattern is normal, the CPU 109 calculates a color misregistration amount (correction amount) on the basis of the pattern detection result (step S114). Next, the CPU 109 corrects the writing start timings of the exposure devices 15*a*, 15*b*, 15*c*, and 15*d* on the basis of the calculated color misregistration amount (correction amount) in step S115. That is, the CPU 109 determines new writing start timings of the exposure devices 15*a*, 15*b*, 15*c*, and 15*d*, stores them into the RAM 119, and finishes the color registration adjustment.

On the other hand, as a result of the determination in the step S113, when the color registration pattern is abnormal ("NO" in the step S113), the CPU 109*a* notifies a user that the pattern position is abnormal through an operation unit (not shown) in step S116, and finishes this process.

According to the process in FIG. 3, it is determined whether the color registration pattern is normal on the basis of not only the number of the pulses at the time of measuring the color registration pattern but also the widths of the pulses. Moreover, it is determined whether the color registration pattern is normal on the basis of the period between the first pulse and the third pulse. This enables to determine the abnormality of the color registration pattern accurately, and enables to notify a user of the result.

Figure 11:
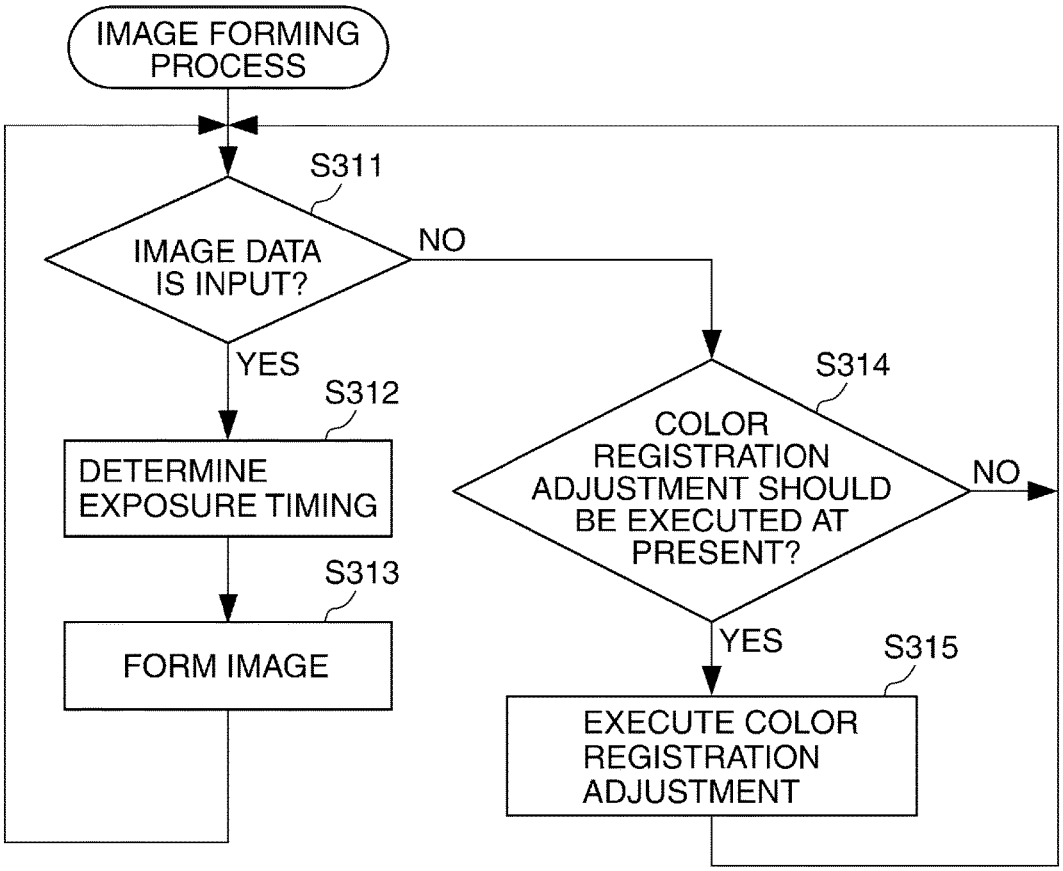
FIG. 11 is a flowchart showing an image forming operation that the image forming apparatus in FIG. 1 corrects an image writing start timing on the basis of a correction amount and forms an image according to image data.

The image forming operation that the image forming apparatus 100 forms an image on a sheet according to image data will be described with reference to FIG. 11. FIG. 11 is a flowchart showing the image forming operation that the image forming apparatus 100 corrects an image writing start timing on the basis of a correction amount and forms an image according to image data. The CPU 109 executes the image forming operation according to a program stored in the ROM 110.

The CPU 109 determines first whether image data is input (step S311). When the image data is input in the step S311, the CPU 109 determines exposure timings on the basis of the write start timings stored in the RAM 119 (step S312). Then, the CPU 109 controls the image forming units 101*a*, 101*b*, 101*c*, and 101*d* to form images on the basis of image data (step S313). After the image forming apparatus 100 forms an image on a sheet, the CPU 109 proceeds with the process to step S311.

On the other hand, as a result of the determination in the step S311, when the image data is not input, the CPU 109 determines whether the color registration adjustment should be executed at present (step S314). For example, when a user inputs a command to execute the color registration adjustment through an operation unit (not shown), or when a temperature difference between an environmental temperature at the time when the last color registration adjustment was executed and a current temperature is more than a predetermined temperature difference, the CPU 109 determines that the color registration adjustment should be executed at present in the step S314. When it is determined that the color registration adjustment should be executed at presents, the CPU 109 executes the color registration adjustment shown in FIG. 3 (step S315).

After the color registration adjustment is executed in the step S315, when determining that the color registration pattern is abnormal, the CPU 109 stops the image forming operation. When the color misregistration amount of the color registration pattern exceeds the tolerance, the CPU 109 determines that the image forming apparatus cannot correct the color misregistration, and prohibits the execution of the image forming operation until the color misregistration amount of the image forming apparatus 100 is fallen within the tolerance.

Moreover, when the CPU 109 determines that the color registration adjustment should not be executed at present in the step S314, the CPU 109 returns the process to the step S311.

Moreover, after the color registration adjustment is executed, when determining that the color registration pattern is normal, the CPU 109 returns the process to the step S311, and waits until image data is input. As mentioned above, the CPU 109 of the image forming apparatus 100 updates the color misregistration amount (correction amount), whenever the color registration adjustment is performed. It should be noted that the CPU 109 repeats the process from the step S311 to the step S314 until the main power supply of the image forming apparatus 100 is turned off, or until the color misregistration amount exceeds the tolerance.

The color registration pattern has a composite pattern. A composite pattern is a superimposed measurement image formed so that a pattern image of a first color and a pattern image of a second color overlap. The pattern image of the first color is formed using the toner of the first color. The pattern image of the second color is formed using the toner of the second color. The toner of the second color is a toner of a predetermined color. The second color (predetermined color) is black, for example. The toner of the first color is a toner of another color different from the predetermined color. The first color is magenta, for example. The reflectance of the toner of the first color is higher than the reflectance of the toner of the second color. The pattern image of the first color included in the composite pattern is sufficient to be read by the pattern detection sensors 7*a* and 7*b* that are used for receiving irregular reflection light.

The reference color pattern is formed using the magenta toner that is identical to the toner of the first color. It should be noted that the reference color pattern may be a yellow pattern or a cyan pattern in place of a magenta pattern as long as a pattern has a high reflectance.

Figure 8:
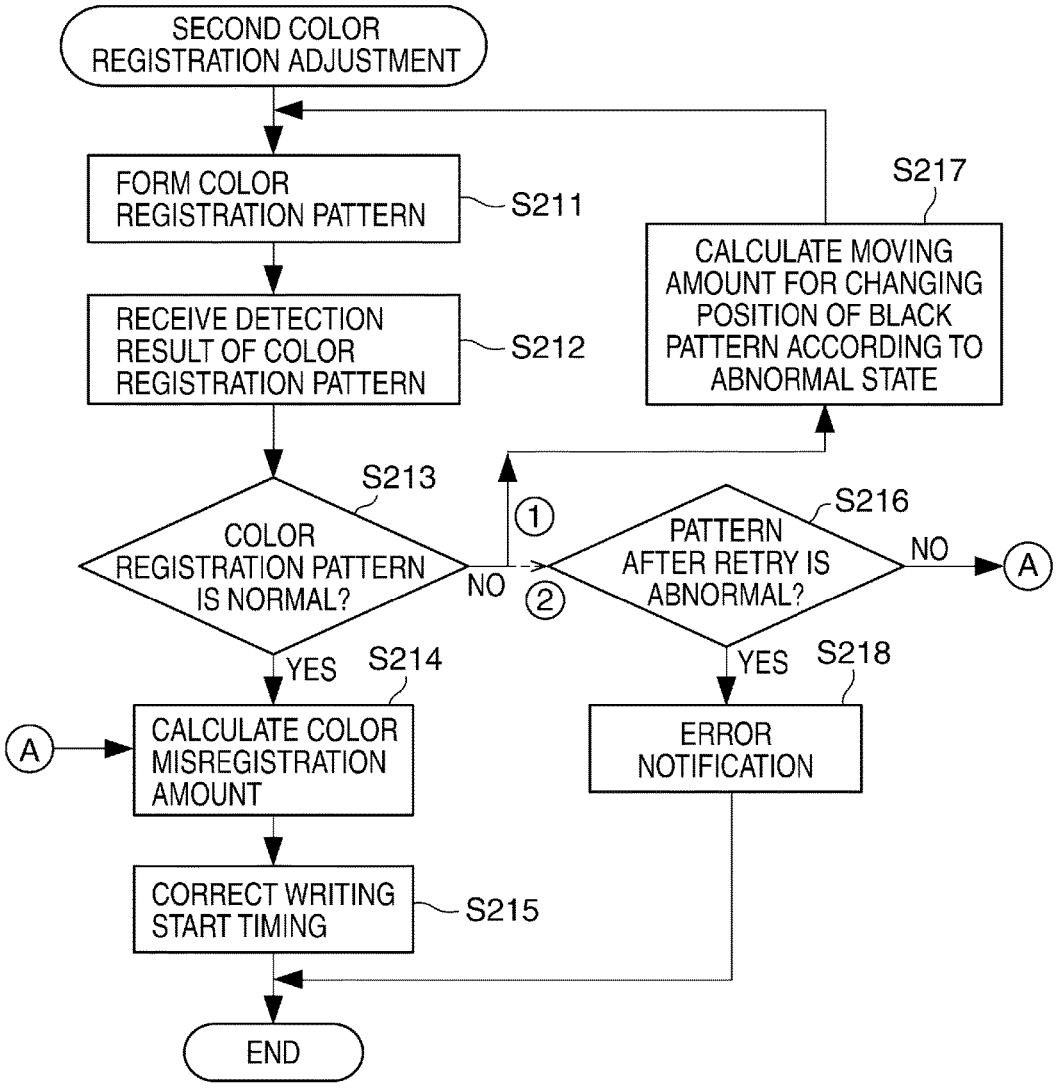
FIG. 8 is a flowchart showing procedures of a second color registration adjustment executed by an image forming apparatus according to a second embodiment of the present invention.

Next, a second embodiment of the present invention will be described. FIG. 8 is a flowchart showing procedures of a second color registration adjustment by an image forming apparatus according to the second embodiment. The configuration of the image forming apparatus in the second embodiment is similar to the configuration of the image forming apparatus in the first embodiment, and its description is omitted.

The CPU 109 of the image forming apparatus 100 performs the second color registration adjustment according to a second color registration adjustment program stored in the ROM 110. In the second color registration adjustment, when the color registration pattern is determined to be in the abnormal state, a new color registration pattern is formed, and the color misregistration is corrected on the basis of the color registration pattern in the normal state.

As shown in FIG. 8, when the second color registration adjustment is started, the CPU 109 controls the image forming units 101*a*, 101*b*, 101*c*, and 101*d* so as to form color registration patterns (step S211). Namely, when executing the color registration adjustment, the CPU 109 generates image data of the four colors that configure the image of the color registration patterns, and outputs them to the image forming units 101*a*, 101*b*, 101*c*, and 101*d*, respectively. The exposure devices 15*a*, 15*b*, 15*c*, and 15*d* of the image forming units 101*a*, 101*b*, 101*c*, and 101*d* respectively form electrostatic latent images on the photosensitive drums 1*a*, 1*b*, 1*c*, and 1*d* by outputting light beams from the laser diodes corresponding to the image data. The electrostatic latent images are developed by the development devices 16*a*, 16*b*, 16*c*, and 16*d*, and are converted into toner images. The toner images formed on the photosensitive drums 1*a*, 1*b*, 1*c*, and 1*d* are sequentially transferred onto the intermediate transfer belt 5 so as to be superimposed. Accordingly, the color registration patterns each of which consists of multicolor pattern images is formed.

After forming the color registration patterns (step S211), the CPU 109 receives the detection results from the pattern detection sensors 7*a* and 7*b* that detected the color registration patterns 400*a* and 400*b* (step S212). The color registration patterns are conveyed with rotation of the intermediate transfer belt 5. The color registration patterns are read by the pattern detection sensors 7*a* and 7*b*, when passing positions directly under the pattern detection sensors 7*a* and 7*b*. That is, the light emitting sections 201 of the pattern detection sensors 7*a* and 7*b* irradiate patterns of the four colors of the color registration patterns 400*a* and 400*b* formed on the intermediate transfer belt 5. Then, the light receiving sections 202 read the color registration patterns by receiving irregular reflection components from the patterns of the four colors, and output signals.

After receiving the detection results about the color registration patterns from the pattern detection sensors 7*a* and 7*b* (step S212), the CPU 109 determines whether the color registration patterns are normal (step S213).

Figure 9:
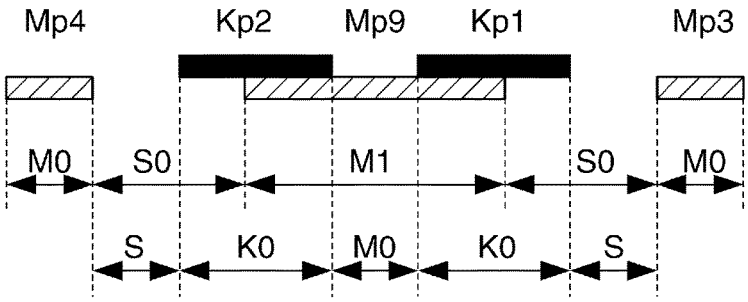
FIG. 9 is a view showing a section of a composite pattern in a color registration pattern in a normal state.

FIG. 9 is a view showing a section of a composite pattern in the color registration pattern in the normal state. FIG. 9 shows design values in a case where black patterns and magenta patterns as the reference color patterns in the composite pattern are formed at ideal positions without color misregistration.

As shown in FIG. 9, symbols M0 indicate periods during which reference color patterns Mp4 and Mp3 and a pattern Mp9 that appears between patterns Kp1 and Kp2 pass the pattern detection sensor 7*a*. Symbols K0 indicate periods during which the patterns Kp1 and Kp2 pass the pattern detection sensor 7*a*. Moreover, symbols S0 indicate periods during which a gap between the patterns Mp3 and Mp9 and a gap between the patterns Mp9 and Mp4 pass the pattern detection sensor 7*a*. Furthermore, symbols S indicate periods during which a gap between the patterns Mp3 and Kp1 and a gap between the pattern Kp2 and Mp4 pass the pattern detection sensor 7*a*. And a symbol M1 indicate a period during which the entire width of the pattern Mp9 passes the pattern detection sensor 7*a*.

Referring back to FIG. 8, as a result of the determination in the step S213, when the color registration pattern is normal ("YES" in the step S213), the CPU 109 calculates a color misregistration amount on the basis of the detection result of the color registration pattern (step S214). Next, the CPU 109 corrects the writing start timing of each exposure device corresponding to the calculated color misregistration amount, stores it to the RAM 119 (step S215), and finishes this color registration adjustment.

On the other hand, as a result of the determination in the step S213, when determining that the composite pattern is abnormal ("NO" in the step S213), the CPU 109 proceeds with the process to the step S217. That is, the CPU 109 calculates a moving amount for changing the positions of the black patterns in order to return the composite pattern to the normal state (step S217).

Hereinafter, a method for returning the composite pattern to the normal state on the basis of the abnormal state of the composite pattern will be described.

Figure 10A:
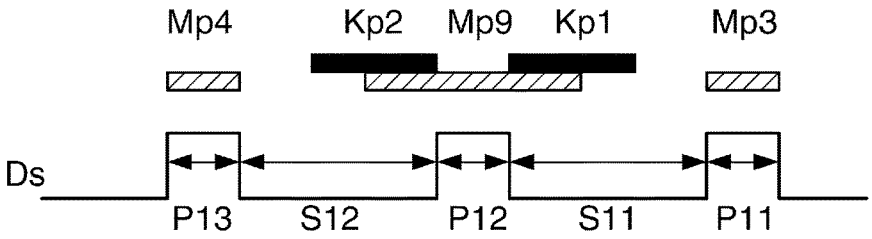
FIG. 10A through FIG. 10I are views showing sections of composite patterns.
Figure 10B:
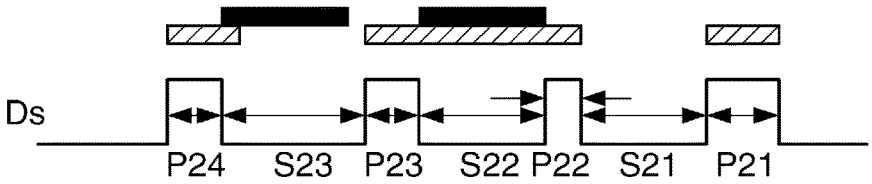
Figure 10C:
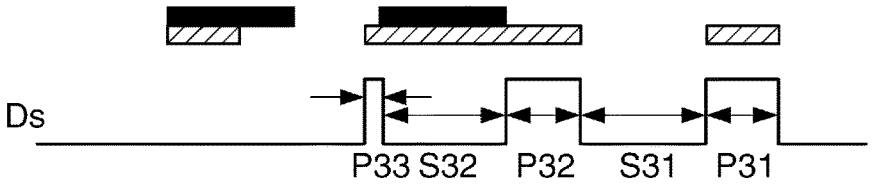
Figure 10D:
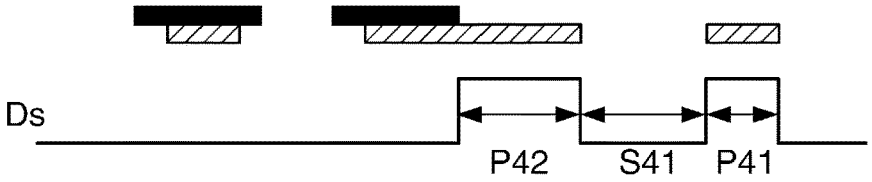
Figure 10E:
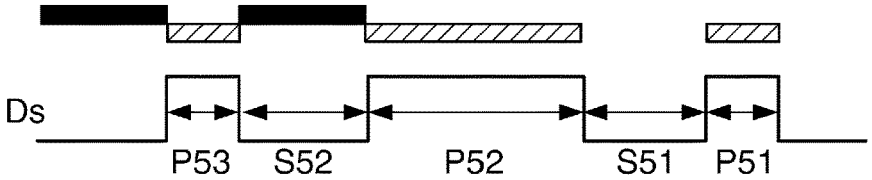
Figure 10F:
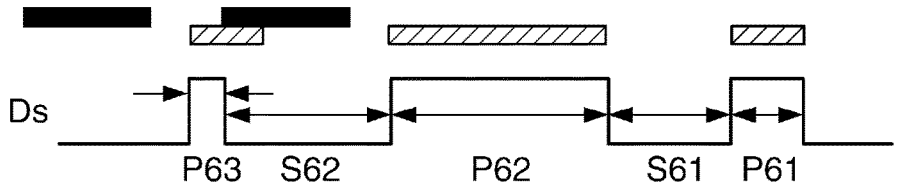
Figure 10G:
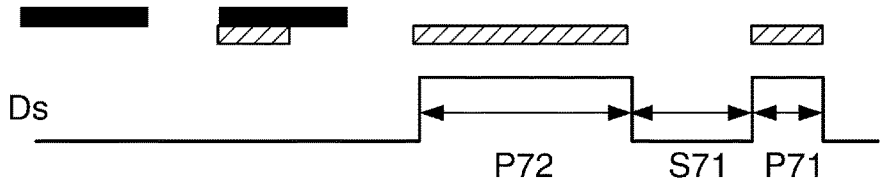
Figure 10H:
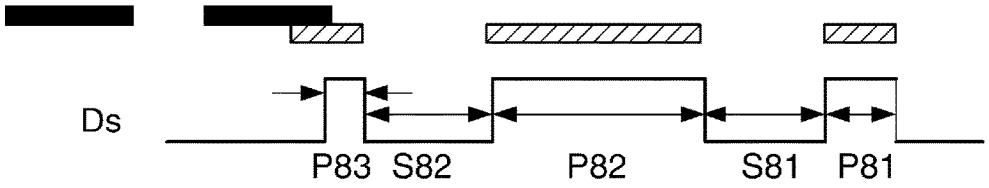
Figure 10I:
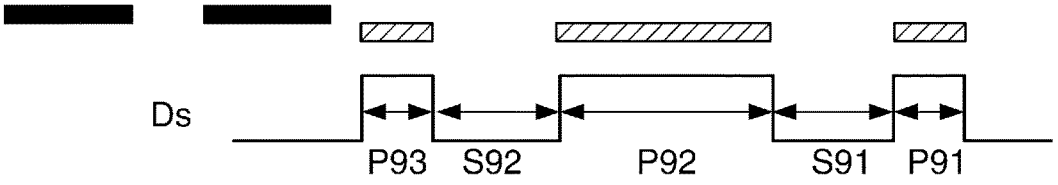

FIG. 10A through FIG. 10I are views showing sections of composite patterns in various states. FIG. 10A is a view showing the composite pattern in the normal state, and FIG. 10B, through FIG. 10I are views showing the composite patterns in the abnormal state, respectively.

In each of FIG. 10A through FIG. 10I, an upper part is a schematic sectional view of the composite pattern, and a lower part shows a waveform of a digital signal obtained by comparing an analog signal with a threshold.

It is determined whether a composite pattern is normal in the same manner as the first embodiment. Namely, when the pulse width obtained from the pattern Mp4, the pulse width obtained from the pattern Mp3, or the pulse width obtained from pattern Mp9 that appears between the patterns Kp1 and Kp2 is outside the predetermined pulse width range, it is determined that the composite pattern is abnormal. Moreover, when a period between the first pulse and the third pulse is outside a predetermined period range, it is determined that the composite pattern is abnormal. The predetermined pulse width range is determined on the basis of a physical width of each pattern at the position where each pattern passes the sensor, the conveyance speed of the color registration pattern, and a pulse width of an ideal digital signal that is determined according to the threshold used when an analog signal is digitized. Moreover, the predetermined period range is determined on the basis of a physical distance between the reference color patterns Mp3 and Mp4, and the conveyance speed of the patterns.

In the case of FIG. 10A, pulse widths P11, P12, and P13 agree with the normal pulse width M0, and a period between the first pulse (width P11) and the third pulse (width P13) also falls within the normal range. Accordingly, the image position is corrected in a usual sequence in this case.

In the case of FIG. 10B, although a width P21 of a first pulse is equal to the normal pulse width M0, pulse widths P22 and P23 of second and third pulses are shorter than the normal width M0, and a period between the first pulse (width P21) and the third pulse (width P23) is also shorter than the normal period. Accordingly, it is determined as an abnormal pattern. Moreover, since a width P24 of a fourth pulse is shorter than the normal pulse width M0 and the period between the first pulse (width P21) and the third pulse (width P23) is shorter than the normal period, it is determined that the pattern Kp1 is positioned on the pattern Mp9 and that the pattern Kp2 partially runs onto the pattern Mp4. In this case, since a middle point between the patterns Kp1 and Kp2 is coincident with a centroid point of the third pulse (width P23), the period from the centroid point of the first pulse to the middle point between the pattern Kp1 and Kp2 becomes P21/2+S21+P22+S22+M0/2. Moreover, an ideal period from the centroid point of the first pulse to the middle point between the patterns Kp1 and Kp2 is equal to M0/2+S+K0+M0/2. Since P21=M0 and S21=S0, correction time becomes S0+P22+S22−S−K0 that is obtained by subtracting (M0/2+S+K0+M0/2) from (M0/2+S0+P22+S22+M0/2), and the composite pattern will be in a normal state by moving the black patterns by the distance corresponding to the correction time.

In the case of FIG. 10C, although a width P31 of a first pulse is equal to the normal pulse width M0, pulse widths P32 and P33 of second and third pulses are shorter than the normal width M0, and a period between the first pulse (width P31) and the third pulse (width P33) is also different from the normal period. Accordingly, it is determined as an abnormal pattern. Since the period between the first pulse (width P31) and the third pulse (width P33) is shorter than the normal period, and there is no pulse following the third pulse (width P33), it is determined that the pattern Kp2 covers the pattern Mp4 and that the pattern Kp1 runs onto the pattern Mp9. In this case, the correction time becomes S0+P32+S32−S−K0 in the same manner as the case of FIG. 10B, the black patterns are moved in the conveyance direction by the distance corresponding to the correction time. As a result of this, the composite pattern will be in the normal state.

In a case of FIG. 10D, although a width P41 of a first pulse is equal to the normal pulse width W0, a width P42 of a second pulse is longer than the pulse width M0 and a third pulse is not detected. Accordingly, it is determined as an abnormal pattern. Since a third pulse is not detected and the width P42 of the second pulse is shorter than the width M1 corresponding to the width of the pattern Mp9, it is determined that the pattern Kp2 covers the pattern Mp4 and that the pattern Kp1 runs onto the pattern Mp9. In this case, an period from the centroid point of the first pulse (width P41) to the middle point between the patterns Kp1 and Kp2 becomes P41/2+S41+P42+K0+M0/2. Since the ideal period from the centroid point of the first pulse to the middle point between the patterns Kp1 and Kp2 is M0/2+S+K0+M0/2 and P41=M0, the correction time becomes S41+P42-S that is obtained by subtracting (M0/2+S+K0+M0/2) from (M0/2+S41+P42+K0+M0/2). The black patterns are moved by the distance corresponding to the correction time. As a result of this, the composite pattern will be in the normal state.

In a case of FIG. 10E, since a width P52 of a second pulse is longer than the normal pulse width M0, it is determined as the abnormal pattern. However, in this case, it cannot be determined whether the black patterns Kp1 and Kp2 sandwich the pattern Mp4 as shown in FIG. 10E, sandwich the pattern Mp3, or are significantly shifted as shown in FIG. 10I. Accordingly, the positions of the black patterns are moved by a distance corresponding to M1/2+S0+M0/2 first, and the color registration adjustment sequence is performed again. As a result, when the composite pattern is in the state in FIG. 10A, the image positions are corrected normally, and the color registration adjustment sequence is finished.

As a result of shifting the positions of the black patterns and performing the color registration adjustment sequence again, when the composite pattern becomes the state of FIG. 10B, FIG. 10C, FIG. 10D, FIG. 10F, FIG. 10G, or FIG. 10H, the black patterns are moved corresponding to each state, and the color registration adjustment sequence is performed again. When the positions of the black patterns are not sure like the case of FIG. 10E or FIG. 10I, the black patterns are moved by a distance corresponding to −(M1/2+S0+M0/2) in the direction that is reverse to the above-mentioned case. Then, the color registration adjustment sequence is performed again. As a result, when the composite pattern is in the state in FIG. 10A, the image positions are corrected normally, and the color registration adjustment sequence is finished. Moreover, when the composite pattern becomes the state of FIG. 10B, FIG. 10C, FIG. 10D, FIG. 10F, FIG. 10G, or FIG. 10H, the black patterns are moved corresponding to each state, and the color registration adjustment sequence is performed again. When the positions of the black patterns are not sure like the case of FIG. 10E or FIG. 10I, a user is notified of an error.

In a case of FIG. 10F, since a width P63 of a third pulse is shorter than the normal pulse width W0 and a width P62 of a second pulse is longer than the normal pulse width M0, it is determined as an abnormal pattern. The pulse width P62 agrees with the width M1 corresponding the width of the pattern Mp9, a period from the centroid point of a first pulse (width P61) to the centroid point of the third pulse (width P63) is longer than that in the normal state. Accordingly, it is determined that the pattern Kp2 is positioned in a delay direction than the pattern Mp4 and that the pattern Kp1 runs onto the pattern Mp4. In this case, an period from the centroid point of the first pulse (width P61) to the middle point between the patterns Kp1 and Kp2 becomes P61/2+S61+P62+M0/2. The ideal period from the centroid point of the first pulse (width P61) to the middle point between the patterns Kp1 and Kp2 is equal to M0/2+S+K0+M0/2. Since P61=M0, a correction time becomes S61+P62+S62−S−K0 that is obtained by subtracting (M0/2+S+K0+M0/2) from (M0/2+S61+P62+S62+M0/2). Accordingly, the black patterns are moved by the distance corresponding to the correction time. As a result of this, the composite pattern will be in the normal state.

In a case of FIG. 10G, since a width P72 of a second pulse agrees with the normal pulse width M1 and a third pulse is not detected, it is determined that the pattern Kp1 covers the pattern Mp4 and that the pattern Kp2 is positioned in the delay direction than the pattern Mp4. In this case, although the middle point between the patterns Kp1 and Kp2 is not determined correctly, the period from a centroid point of a first pulse (width P71) to the middle point falls within a range between P71/2+S71+P72+S0+M0+M0/2 and P71/2+S71+P72+S0+K0+M0/2. Accordingly, it is assumed that the middle point between the patterns Kp1 and Kp2 is positioned at the center of the range (i.e., the period from the centroid point of the first pulse to the middle point is equal to P71/2+S71+P72+S0+K0/2+M0). The ideal period from the centroid point of the first pulse (width P71) to the middle point between the patterns Kp1 and Kp2 is equal to M0/2+S+K0+M0/2. Since P71=M0, S71=S0, and P72=M1, a correction time becomes 2S0+M1+M0/2−S−K0/2 that is obtained by subtracting (M0/2+S+K0+M0/2) from (M0/2+S0+M1+S0+K0/2+M0), and the black patterns are moved by the distance corresponding to the above-mentioned correction time. As a result of this, the composite pattern will be in the normal state.

In a case of FIG. 10H, since a width P83 of a third pulse is shorter than the normal pulse width M0 and a width P82 of a second pulse agrees with the width M1 corresponding to the width of the pattern Mp9, it is determined as an abnormal pattern. Moreover, since the period from a first pulse (width P81) to the third pulse (width P83) is shorter than that in the normal state, it is determined that the pattern Kp2 is positioned in the delay direction than the pattern Mp4 and that the pattern Kp1 runs onto the rear edge of the pattern Mp4. Accordingly, a period from the centroid point of the first pulse (width P81) to the middle point between the patterns Kp1 and Kp2 becomes P81/2+S81+P82+S82+P83+K0+M0/2. The ideal period from the centroid point of the first pulse (width P81) to the middle point between the patterns Kp1 and Kp2 is equal to M0/2+S+K0+M0/2. Since P81=M0, S81=S0, P82=m1, and S82=S0, a correction time becomes 2S0+M1+P83−S that is obtained by subtracting (M0/2+S+K0+M0/2) from (M0/2+S0+M1+S0+P83+K0+M0/2), and the black patterns are moved by the distance corresponding the above-mentioned correction time. As a result of this, the composite pattern will be in the normal state.

In a case of FIG. 10I, the middle point between the pattern Kp1 and Kp2 is detected by the same sequence as the case of FIG. 10E, and the black patterns are moved.

As mentioned above, when the abnormal state of the image positions of the black patterns is detected and the black patterns are returned to the normal positions, the process returns to the normal color registration adjustment sequence.

Referring back to FIG. 8, after finding the moving amount (writing-start-timing correction amount) of the black patterns for making the composite pattern into the normal state, the CPU 109 forms the color registration pattern again while correcting the writing start timing of the black patterns (step S211). Next, the CPU 109 receives the pattern detection signal (step S212), and determines whether the color registration pattern is normal (step S213).

As a result of the determination in the step S213, when the color registration pattern is normal ("YES" in the step S213), the CPU 109 calculates the color misregistration amount on the basis of the detection result of the color registration pattern (step S214) as mentioned above. Next, the CPU 109 corrects the writing start timing of each exposure device corresponding to the calculated color misregistration amount (step S215), and finishes this process.

On the other hand, as a result of the determination in the step S213, when the composite pattern is determined as abnormal ("NO" in the step S213), the CPU 109 determines again whether the composite pattern is abnormal even after a retry (step S216). As a result of the determination in the step S216, when determining that the abnormality is cancelled and the composite pattern is normal ("NO" in the step S213), the CPU 109 proceeds with the process to the step S214.

Moreover, as a result of the determination in the step S216, when the composite pattern is abnormal even after the retry ("YES" in the step S216), the CPU 109 notifies a user of an error through the operation unit (not shown) in step S218. Then, the CPU 109 finishes this process after the error notification.

According to the process in FIG. 8, the abnormality of the composite pattern in the color registration pattern is detected on the basis of not only the number of the pulses based on the pattern but also the period that is the width of each pulse and the period that is the interval between the specific pulses. This allows detecting the abnormality of the composite pattern correctly.

Moreover, according to the second embodiment, the moving amount of the black patterns for returning the composite pattern to the normal state is found corresponding to the abnormal state of the composite pattern (step S217), and the color registration pattern is reformed using the found moving amount (step S211). As a result of this, since the color misregistration is properly corrected using the reformed color registration pattern in the normal state, a normal image is output while avoiding outputting an abnormal image.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-211849, filed Oct. 28, 2015, which is hereby incorporated by reference herein in its entirety.

What is claimed is:

1. An image forming apparatus comprising:

an image bearing member;

a first image forming unit configured to form a first image on the image bearing member using a first color toner where reflectance is higher than the image bearing member;

a second image forming unit configured to form a second image on the image bearing member using a second color toner where reflectance is lower than the first color toner;

an irradiation unit configured to irradiate the image bearing member with light;

an output unit including a light receiving section that receives reflected light from the image bearing member, and configured to output a signal based on a light receiving result of the light receiving section; and a processor configured to implement instructions stored in a memory and execute a plurality of tasks, including:

a formation task that controls the first image forming unit and the second image forming unit to form a plurality of measurement images on the image bearing member, wherein the plurality of measurement images include:

a first measurement image formed by the first image forming unit;

a second measurement image formed by the first image forming unit;

a third measurement image formed by the first image forming unit; and a superimposing measurement image formed by the second image forming unit, superimposed on the second measurement image, wherein the second measurement image is formed between the first measurement image and the third measurement image;

an obtaining task that controls the irradiation unit and the output unit to obtain the signal, which includes a plurality of pulse signals, corresponding to a light receiving result of the reflected lights from the plurality of measurement images received by the light receiving section;

a determining task that determines whether a predetermined condition regarding a period from a first pulse signal, among the plurality of pulse signals, to a third pulse signal, among the plurality of pulse signals, is satisfied;

a detection task that detects color misregistration based on the signal obtained by the obtaining task; and a control task that controls based on the color misregistration detected by the detection task, an image forming position of the second image to be formed by the second image forming unit, wherein the processor does not execute the control task in a case where the predetermined condition is not satisfied.

2. The image forming apparatus according to claim 1, wherein the superimposing measurement image includes a slit that is prolonged in a direction that intersects a conveyance direction of the image bearing member so that the second measurement image appears in the slit.

3. The image forming apparatus according to claim 1, wherein the processor prohibits the detection task from detecting the color misregistration in a case where the predetermined condition is not satisfied.

4. The image forming apparatus according to claim 1, wherein the first color toner is magenta and the second color toner is black.

5. The image forming apparatus of the claim 1, wherein the light receiving section of the output unit receives irregular reflection light.

6. The image forming apparatus according to claim 1, wherein the processor skips the detection task in a case where the predetermined condition is not satisfied.

7. The image forming apparatus according to claim 1, wherein:

the superimposing measurement image includes a first superimposing measurement image and a second superimposing measurement image, the first superimposing measurement image and the second superimposing measurement image are separated by a predetermined distance in a conveyance direction of the image bearing member, and the second measurement image appears between the first superimposing measurement image and the second superimposing measurement image.

8. The image forming apparatus according to claim 1, wherein the predetermined condition is satisfied in a case where the period is within a predetermined period.

9. An image forming apparatus comprising:

an image bearing member;

a first image forming unit configured to form a first image on the image bearing member using a first color toner where reflectance is higher than the image bearing member;

a second image forming unit configured to form a second image on the image bearing member using a second color toner where reflectance is lower than the first color toner;

an irradiation unit configured to irradiate the image bearing member with light;

an output unit including a light receiving section that receives reflected light from the image bearing member, and configured to output a signal based on a light receiving result of the light receiving section; and a processor configured to implement instructions stored in a memory and execute a plurality of tasks, including:

a formation task that controls the first image forming unit and the second image forming unit to form a plurality of measurement images on the image bearing member, wherein the plurality of measurement images include:

a first measurement image formed by the first image forming unit;

a second measurement image formed by the first image forming unit;

a third measurement image formed by the first image forming unit; and a superimposing measurement image formed by the second image forming unit superimposed on the second measurement image, wherein the second measurement image is formed between the first measurement image and the third measurement image;

an obtaining task that controls the irradiation unit and the output unit to obtain the signal, which includes a plurality of pulse signals, corresponding to light receiving result of the reflected lights from the plurality of measurement images received by the light receiving section;

a determining task that determines a detection error caused by a shift of an image forming position of the superimposing measurement image based on a period from a first pulse signal, among the plurality of pulse signals, to a third pulse signal, among the plurality of pulse signals;

a detection task that detects color misregistration based on the signal obtained by the obtaining task;

a control task that controls, based on the color misregistration detected by the detection task, an image forming position of the second image to be formed by the second image forming unit, wherein the processor does not execute the control task in a case where the detection error is determined by the determining task.

10. The image forming apparatus according to claim 9, wherein the superimposing measurement image includes a slit that is prolonged in a direction that intersects a conveyance direction of the image bearing member so that the second measurement image appears in the slit.

11. The image forming apparatus according to claim 9, wherein the processor prohibits the detection task from detecting the color misregistration in a case where the detection error is determined by the determining task.

12. The image forming apparatus according to claim 9, wherein the first color toner is magenta and the second color toner is black.

13. The image forming apparatus of the claim 9, wherein the light receiving section of the output unit receives irregular reflection light.

14. The image forming apparatus according to claim 9, wherein the processor skips the detection task in a case where the detection error is determined by the determining task.

15. The image forming apparatus according to claim 9, wherein:

the superimposing measurement image includes a first superimposing measurement image and a second superimposing measurement image, the first superimposing measurement image and the second superimposing measurement image are separated by a predetermined distance in a conveyance direction of the image bearing member, and the second measurement image appears between the first superimposing measurement image and the second superimposing measurement image.

16. The image forming apparatus according to claim 9, wherein the determining task determines the detection error in a case where the period is outside a predetermined period.

* * * * *